US008191723B2

(12) United States Patent
Donaldson

(10) Patent No.: US 8,191,723 B2
(45) Date of Patent: Jun. 5, 2012

(54) APPARATUS FOR STORING A FLOWABLE PRODUCT

(75) Inventor: Stuart Donaldson, Campbellfield (AU)

(73) Assignee: Stuart Donaldson, Campbellfield (AU)

( * ) Notice: Subject to any disclaimer, the term of this patent is extended or adjusted under 35 U.S.C. 154(b) by 354 days.

(21) Appl. No.: 12/468,223

(22) Filed: May 19, 2009

(65) Prior Publication Data

US 2009/0283522 A1 Nov. 19, 2009

(30) Foreign Application Priority Data

May 19, 2008 (AU) ..... 2008902464

(51) Int. Cl.
*B65D 25/00* (2006.01)
*B65D 90/02* (2006.01)

(52) U.S. Cl. ..... 220/9.4; 220/565; 220/646

(58) Field of Classification Search ..... 220/9.1–9.4, 220/565, 648, 686; 248/150; 4/506
See application file for complete search history.

(56) References Cited

U.S. PATENT DOCUMENTS

| | | | | |
|---|---|---|---|---|
| 2,391,374 | A * | 12/1945 | Wickstrum | 52/63 |
| 3,031,688 | A * | 5/1962 | Southwood | 5/120 |
| 3,225,362 | A * | 12/1965 | Barrera | 52/169.1 |
| 4,356,933 | A * | 11/1982 | Connolly | 220/9.4 |
| 4,847,926 | A * | 7/1989 | Laputka | 4/506 |
| 5,592,702 | A * | 1/1997 | Gillebaard, Jr. | 4/506 |
| 6,795,986 | B2 * | 9/2004 | Marbach et al. | 4/506 |

FOREIGN PATENT DOCUMENTS

GB 2039216 A * 8/1980

* cited by examiner

*Primary Examiner* — Harry Grosso
(74) *Attorney, Agent, or Firm* — Graybeal Jackson LLP

(57) ABSTRACT

There is disclosed an apparatus for storing flowable product. The apparatus has a receptacle formed of a fabric that is impermeable to the flowable product, and further has a base, at least one upstanding side wall and a brim. One or more lateral bracing members are disposed between the base and the brim of the receptacle and abutting the at least one side wall of the receptacle.

15 Claims, 7 Drawing Sheets

APPARATUS FOR STORING A FLOWABLE PRODUCT

PRIORITY CLAIM

This application claims the benefit of Australian Patent Application Serial No. 2008902464, filed May 19, 2008, which application is incorporated herein by reference in its entirety.

FIELD OF THE INVENTION

The present invention relates to an apparatus for storing a flowable product.

BACKGROUND

It is known to use independent rigid water tanks to augment civil water reticulated systems. The independent tanks receive water from sources such as the roofs of houses and sheds.

Transport of rigid water tanks is inefficient due to the volume of free space that is transported with the tank. When demand for rigid tanks is high, the price of tanks increases and delivery time is lengthened.

There have been many attempts to provide fabric tanks as a cheap, ready and easy to transport alternative to the traditional rigid plastic, concrete or metal tanks.

One fabric tank has the shape of an inverted cone and is self-supporting. The geometry of the side wall provides stability to the tank. However, the height of the tank is limited due to the limited ability of the fabric to withstand the water pressure exerted.

Another fabric tank is an entirely sealed bladder, which has limited depth and limited storage capacity and the bladder is very unstable when only partly full and must be secured or contained to prevent movement.

A third example is a cylindrical fabric tank with a rigid frame supporting the brim, however the depth is limited and the frame is unstable.

A fourth example is a cylindrical tank made from rigid sheet or mesh that has a waterproof fabric or film liner within it. The sheets are generally large and unwieldy and are of heavy construction in order to withstand the hoop stresses.

The above-described examples of so-called fabric tanks have one or more deficiencies. There is a need for an improved apparatus for storing flowable product that can be used as, for example, a water storage tank.

SUMMARY OF THE INVENTION

The present invention provides an apparatus for storing flowable product comprising:

a receptacle formed of a fabric that is impermeable to the flowable product, the receptacle having a base, at least one upstanding side wall and a brim, and one or more lateral bracing members disposed between the base and the brim of the receptacle and abutting the at least one side wall of the receptacle.

In an embodiment where the at least one side wall is cylindrical, the lateral bracing members can support hoop stresses in cylindrical side wall generated by flowable product that is contained within the receptacle.

Thus, the lateral bracing members relieve hoop stress from the fabric, which enables the receptacle to be constructed to a greater height.

In this embodiment, the lateral bracing members are in the form of hoops.

Preferably, the flowable product is water and the fabric of the receptacle is water impermeable.

In embodiments in which the apparatus has a single lateral bracing member, that lateral bracing member is located closer to the base of the receptacle than the brim.

In embodiments in which the apparatus has two lateral bracing members, the vertical separation of the lateral bracing members is greater than the vertical height of the lower lateral bracing member from the base of the receptacle.

In other embodiments in which the apparatus has three or more lateral bracing members, the vertical separation of adjacent lateral bracing members increases with vertical height from the base of the receptacle.

Preferably, the apparatus further comprises a top supporting member that supports the brim of the receptacle.

Preferably, the receptacle has keeper sleeves within which the lateral bracing members are contained.

In one embodiment, the lateral bracing members are in the form of strips of inelastic material. The strips may be made of metal. In some alternative embodiments, the strips may be made of an inelastic plastics material.

In certain further alternative embodiments, the lateral bracing members are each formed of an elongate member that is made of a plurality of twisted and/or woven strands.

The lateral bracing members may be formed of a plurality of segments that are connected to form the lateral bracing member.

Ends of the lateral bracing members may be permanently or releasably joined.

Preferably, the apparatus has a frame for supporting the receptacle.

Preferably, the frame comprises a plurality of upright columns that are external to the lateral bracing members, and one or more circumferential rings. In some embodiments, the rings are external to the columns.

Preferably, the outer diameter of the rings is larger than the diameter of the receptacle when filled with product. Thus, when the receptacle is filled with product and bulges outwardly, the fabric does not protrude beyond the periphery of the frame.

In certain embodiments, the diameters of the lateral bracing members, the receptacle, and the frame are selected such that, when the receptacle is filled with product, the greatest diameter of the stretched fabric is less than or equal to the innermost diameter of the frame.

Preferably, the columns are equally spaced about the periphery of the receptacle.

The apparatus may further comprise an external cladding that is attached to the rings.

Preferably, the plurality of rings include a top ring that supports the brim of the receptacle.

Preferably, the plurality of rings include a bottom ring that is located toward the base of the apparatus.

Preferably, the plurality of rings includes one or more intermediate rings located between the top and bottom rings.

In some embodiments, each ring is formed of a plurality of ring segments. The ends of the ring segments can abut one another to form the ring.

In some embodiments, the apparatus further comprises connectors that each extend between the top lateral bracing member and the top ring such that the ring supports the brim of the receptacle.

In one preferred embodiment, the frame includes gussets that each extend between one of the columns and one of the rings to provide increased rigidity to the frame. Thus, the gussets provide increased stability to the apparatus.

Preferably, each gusset is formed of substantially rigid material.

Alternatively, the receptacle has three or more side walls.

The side walls may be substantially planar in the absence of liquid in the receptacle. Thus, the lateral bracing members and rings may both be formed of substantially straight segments.

Alternatively, the side walls may be curved. Thus, the lateral bracing members and rings may both be formed of curved segments.

The apparatus may further comprise a plurality of restraints for locating a lower portion of the receptacle relative to the frame.

In some embodiments, each restraint includes a tab connected to the receptacle, the tab having an aperture through which a fastener can pass.

The present invention also provides a kit for an apparatus for storing flowable product comprising:

a receptacle formed of a fabric that is impermeable to the flowable product, the receptacle having a base, at least one upstanding side wall and a brim, and one or more lateral bracing members that are to extend around the at least one side wall of the receptacle, wherein the apparatus can be assembled such that each lateral bracing member is disposed between the base and the brim and is in abutment with the at least one side wall of the receptacle.

BRIEF DESCRIPTION OF THE DRAWINGS

In order for the present invention to be more easily understood, embodiments will now be described, by way of example only, with reference to the accompanying drawings, in which.

DETAILED DESCRIPTION

Figure 1:
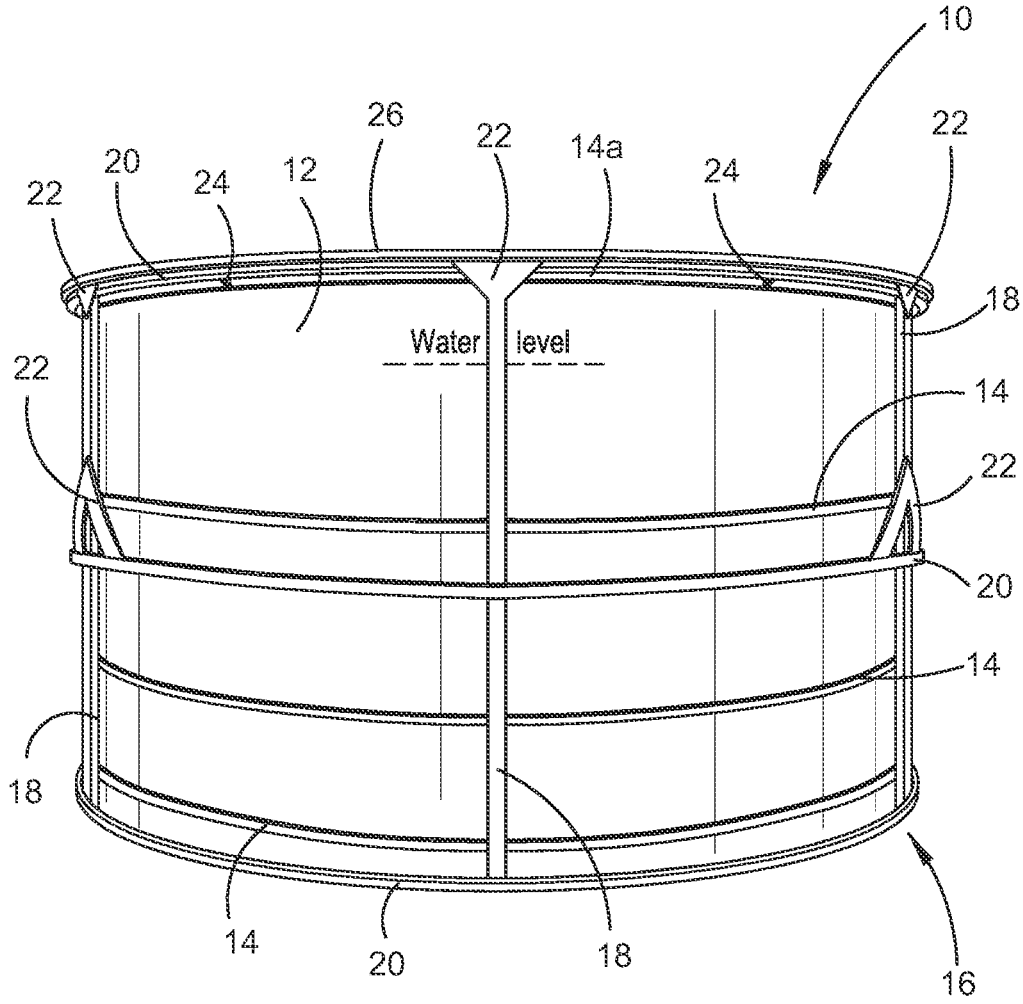
FIG. 1: is a perspective view of an apparatus according to a first embodiment of the present invention.

FIG. 1 shows an apparatus 10 for storing a flowable product according to a first embodiment of the present invention. The apparatus 10 has a receptacle 12 within which the flowable product, such as water, can be stored. The receptacle 12 is formed of a liquid impermeable fabric, such as a polyvinyl. Thus, the receptacle 12 is watertight.

The receptacle 12 has a base (not shown) and an upstanding side wall. In this embodiment, the receptacle 12 is cylindrical.

Lateral bracing members, which in this embodiment are in the form of hoops 14, extend transversely around the side wall of the receptacle 12. The side wall of the receptacle 12 bears radially outward against the hoops 14. Hoop stresses of the receptacle 12, which are generated by outward pressure of liquid within the receptacle 12, are supported by the hoops 14. Accordingly, hoop stresses are relieved from the fabric and transferred to the hoops 14.

The apparatus 10 further has a frame 16 that supports the receptacle 12. In this regard, the frame 16 supports the brim of the receptacle 12, and also locates the receptacle 12 to prevent it from being unintentionally moved. The base of the receptacle 12 can rest on the ground (as shown in FIG. 1). Alternatively, the base can rest on a purpose built footing.

The hoops 14 are formed of a material that is relatively inelastic compared with the fabric of the receptacle 12. Thus, the hoops 14 limit the extent to which the receptacle 12 is able to bulge outwardly. As will be appreciated, the hydrostatic force of liquid increases with the height of the column of liquid, with the maximum force found at the lowest point of the column. Thus, the maximum radially outward force of liquid contained within the receptacle 12 increases as the height of the full receptacle. The elastic nature of the fabric means that the receptacle would bulge excessively if the hoop stresses were supported entirely by the fabric.

The vertical height of each hoop 14 is selected based on the extent to which the fabric between the hoops 14 is to be allowed to stretch.

In the embodiment shown in FIG. 1, the hoops 14 are formed of a plurality of hoop segments in the form of curved strips of metal. The hoop segments are joined at their ends to form each hoop 14.

Furthermore, the apparatus 10 shown in FIG. 1 has three hoops 14 positioned between the base and brim of the receptacle 12. As can be seen in FIG. 1, the vertical separation of adjacent hoops 14 increases with vertical distance from the base of the receptacle 12. The apparatus 10 further has a top supporting hoop 14*a* positioned at the brim of the receptacle 12 to support the top of the receptacle 12.

The frame 16 consists of a plurality of upright columns 18 that are external to the hoops 14, and circumferential rings 20. In this embodiment, the rings 20 are supported by the columns 18 such that the rings 20 are on the external side of the columns 18 with respect to the receptacle 12. In this embodiment, there are three rings 20: a bottom ring adjacent the base of the receptacle 12, a top ring adjacent the brim of the receptacle 12, and an intermediate ring.

The columns 18 are equally spaced about the periphery of the receptacle 12.

The outer diameter of the rings 20 is larger than the diameter of the receptacle 12 when filled with liquid. The apparatus 10 shown in FIG. 1 is almost completely filled with liquid. The approximate water level of the apparatus 10 is indicated by the broken line in FIG. 1. When the receptacle 12 is filled with liquid and bulges outwardly, the fabric does not protrude beyond the outer periphery of the frame 16.

The frame 16 also has gussets 22 that each extend between a column 18 and a ring 20 to provide increased rigidity to the frame 16 at the respective intersection of the column 18 and ring 20.

The apparatus 10 can further include a lid 26 to cover and/or close the receptacle 12 to minimize the opportunity for rubbish and debris to come into contact with liquid contained within the apparatus 10.

To locate and support the brim of the receptacle 12 with respect to the frame 16, connectors 24 extend between the top ring 20 and the top hoop 14.

Figure 2:
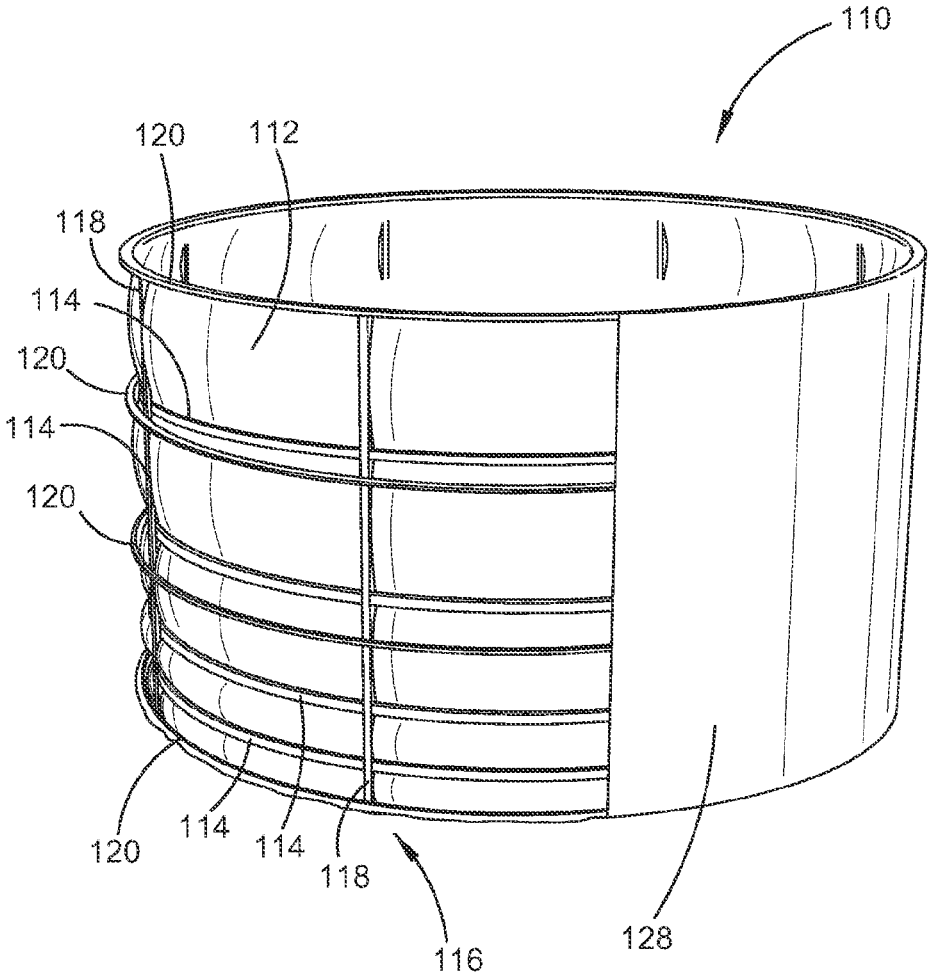
FIG. 2: is a schematic illustration of an apparatus according to a second embodiment of the present invention.

FIG. 2 shows a liquid storage apparatus 110 according to a second embodiment of the present invention. The apparatus 110 has many features similar to that of the apparatus 10 of the first embodiment. Accordingly, features of the apparatus 110 that generally correspond with features of the apparatus 10 shown in FIG. 1 have been assigned corresponding reference numerals incremented by 100.

The apparatus 110 includes five hoops 114 that extend around the side wall of the receptacle 112. The top supporting hoop, which supports the brim of the receptacle 112, is not visible in FIG. 2.

The frame 116 has four rings 120 of which two are intermediate rings 120 that are disposed between the top and bottom rings 120.

The apparatus 110 includes a superficial cladding 128 that is attached to the frame 116. In FIG. 2, the cladding 128 has been shown around a portion of the apparatus 110 to allow other features of the apparatus 110 to be seen. However, it will be appreciated that the cladding 128 would desirable extend entirely around the apparatus 110. The cladding 128 is provided merely to improve the aesthetic appeal of the apparatus 110. The cladding 128 can be any desired form including (but not limited to) sheet metal, rendered plastics, and wood brush panels.

The outer diameter of the rings 120 is larger than the diameter of the receptacle 112 when filled with liquid. Thus, when the receptacle 112 is filled with liquid and bulges outwardly, the fabric does not protrude beyond the periphery of the frame 116 and does not contact the cladding 128.

Figure 3:
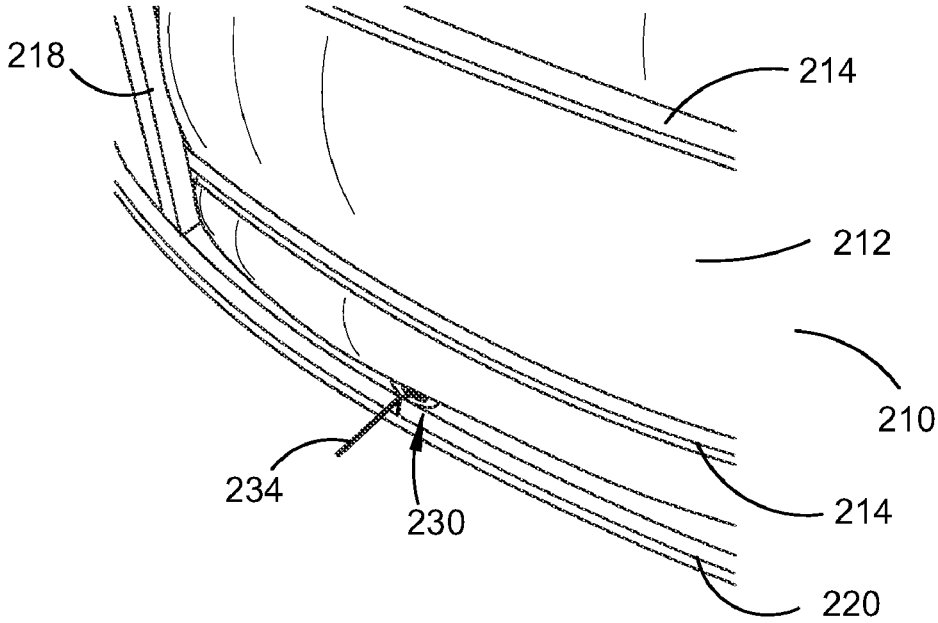
FIG. 3: is an enlarged view of a lower portion of an apparatus according to a third embodiment of the present invention.
Figure 4:
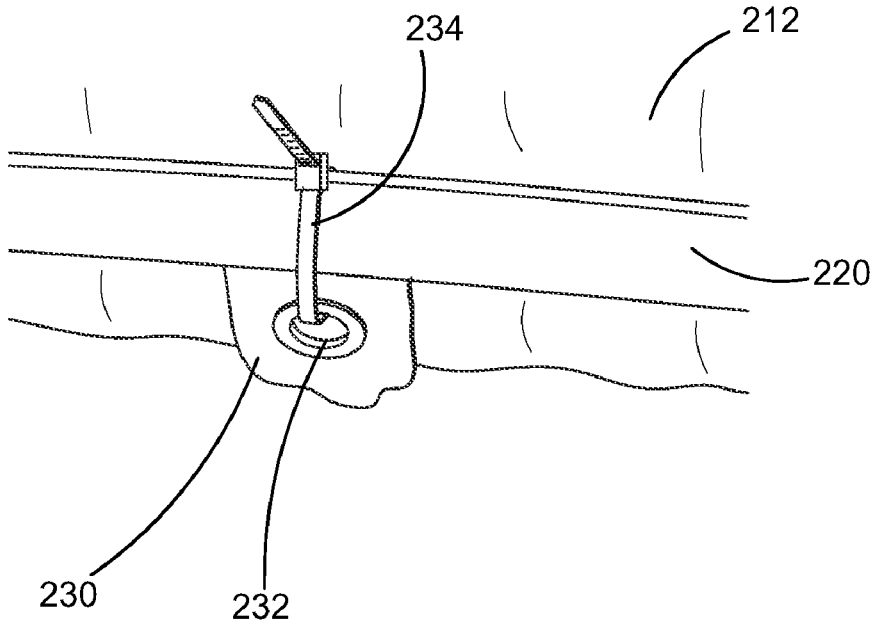
FIG. 4: is a further enlarged view of the apparatus of FIG. 3.
Figure 5:
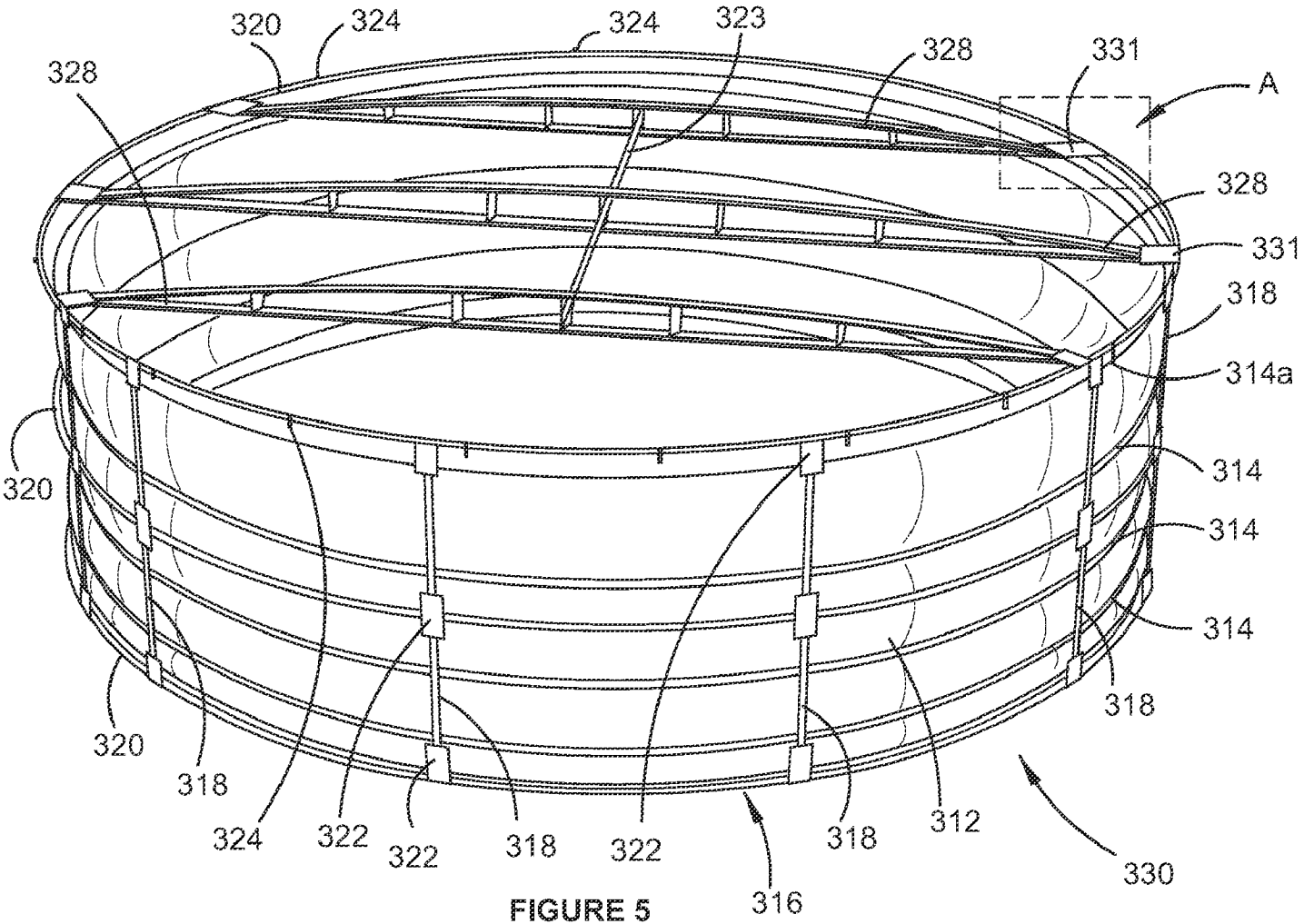
FIG. 5: is a schematic perspective view of an apparatus according to a fourth embodiment of the present invention.
Figure 6:
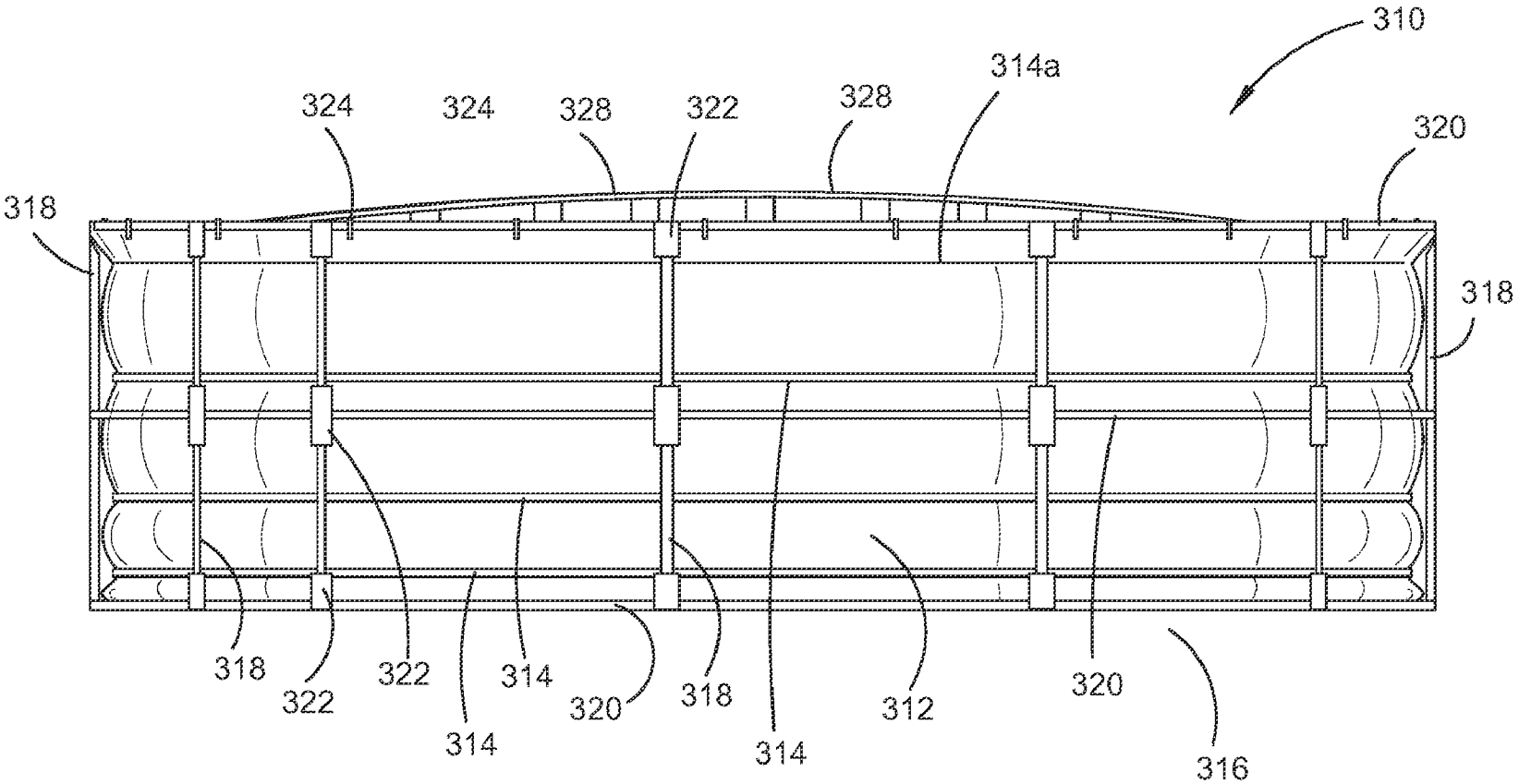
FIG. 6: is a schematic side elevation view of the apparatus of FIG. 4.
Figure 7:
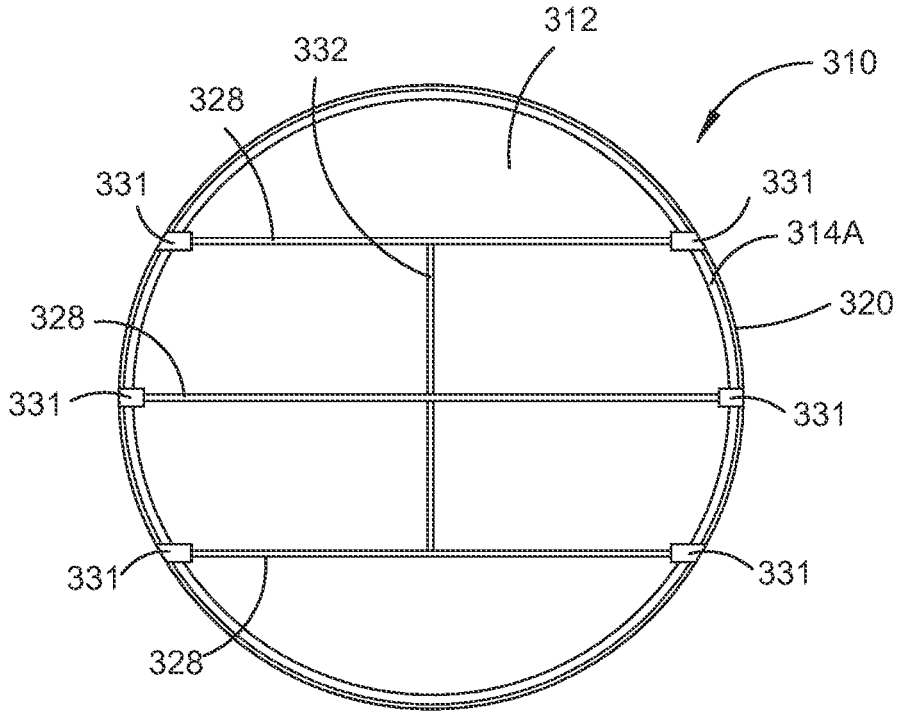
FIG. 7: is a schematic top view of the apparatus of FIG. 4.

FIGS. 3 and 4 show a lower portion of a liquid storage apparatus 210 according to a third embodiment of the present invention. Features of the apparatus 210 that generally correspond with features of the apparatus 10 shown in FIG. 1 have been assigned reference numerals incremented by 200.

The apparatus 210 includes restraints 230 for locating the lower portion of the receptacle 212 relative to the frame 216. In particular, the restraints 230 locate and restrain the base (not shown) of the receptacle 212 to the bottom ring 220. The restraints 230 ensure that the receptacle 212 when empty is centrally located in the frame 216. Thus, as the receptacle 212 is filled, the base and side walls remain centrally located within the frame 16.

In this embodiment, each restraint 230 includes a tab that is attached to the receptacle 212. The tab has an aperture through which a fastener can extend. In this embodiment, the tab is in the form of fabric flap and the aperture is defined by an eyelet 232 is located in the flap. The flap is secured to the bottom ring 220 by a fastener, such as cable tie 234, that passes through the eyelet 232 and around the bottom ring 220. The flap can be made of polyvinyl.

In other embodiments, each restraint 230 may be secured to a footing beneath the receptacle 212 using fasteners. In other embodiments, each restraint 230 may be connected to the frame 216 by a spring.

FIGS. 5 to 8 show an apparatus for storing a flowable product 310 according to a fourth embodiment of the present invention. The apparatus 310 has many features similar to that of the apparatus 10 of the first embodiment. Accordingly, features of the apparatus 310 that generally correspond with features of the apparatus 10 shown in FIG. 1 have been assigned corresponding reference numerals incremented by 300.

The apparatus 310 differs from the apparatus 10 in that the diameters of the hoops 314 the receptacle 312, and also the frame 316 are selected such that, when the receptacle 312 is full of liquid, the greatest diameter of the stretched fabric is less than or equal to the innermost diameter of the frame 316. Thus, in this embodiment, the receptacle 312, when filled with liquid, will exert minimal lateral force on the frame 316.

In certain embodiments in which the hoops 314 have some elasticity, the diameter of the hoops 314 will be selected to accommodate this elasticity, whilst maintaining the condition that, when the receptacle 312 is full of liquid, the greatest diameter of the stretched fabric is less than or equal to the innermost diameter of the frame 316.

The apparatus 310 also includes trusses 328 that support a lid (which is omitted from FIGS. 5 to 8). The trusses 328 have supports members 331 at each end. The support members 331 enable the trusses 328 to be supported on the frame 316. A transverse support member 332 connects the trusses 328 to provide increased rigidity to the lid.

Figure 8:
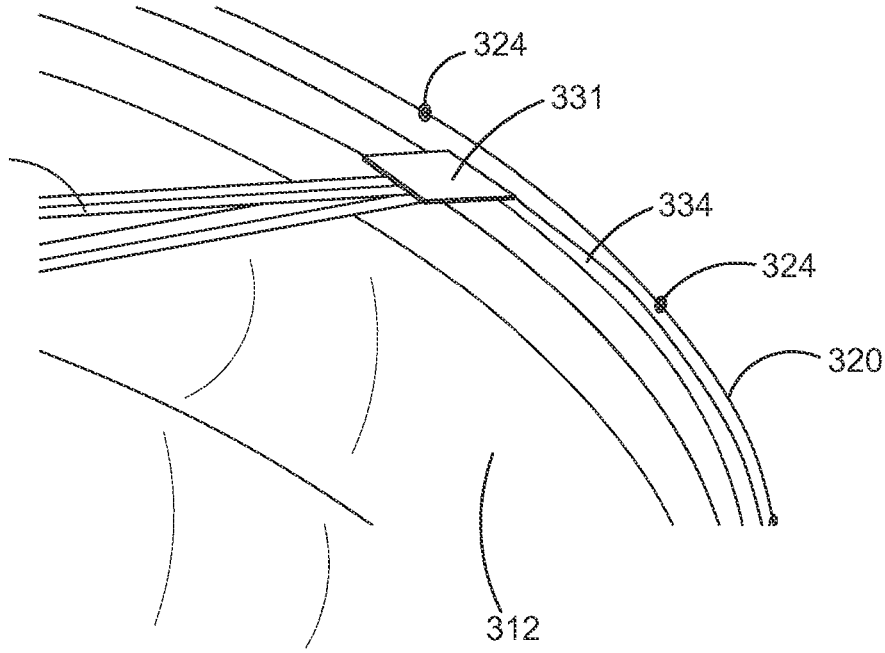
FIG. 8: is an enlarged schematic view of region A, indicated in FIG. 5.

As shown most clearly in FIG. 8, the top ring 320 of the frame 316 has a shoulder 334 on which the support members 331 rest. The support members 331 can be fastened to the top ring 320 to secure the trusses 331 to the frame 316.

The brim of the receptacle 312 is connected to the top ring 320 of the frame 316 by connectors 324 that extend between the top ring 320 and the brim. The apparatus 310 further has a top supporting hoop **314*a* positioned adjacent the brim of the receptacle 312 to support the top of the receptacle 312. Fabric material extends outwardly from the top supporting hoop 314*a*** to the brim.

In this embodiment, the gussets 322 join the columns 318 to the rings 320. The gussets 322 may also serve as a mount for attaching cladding (not shown) to the frame 316.

Figure 9:
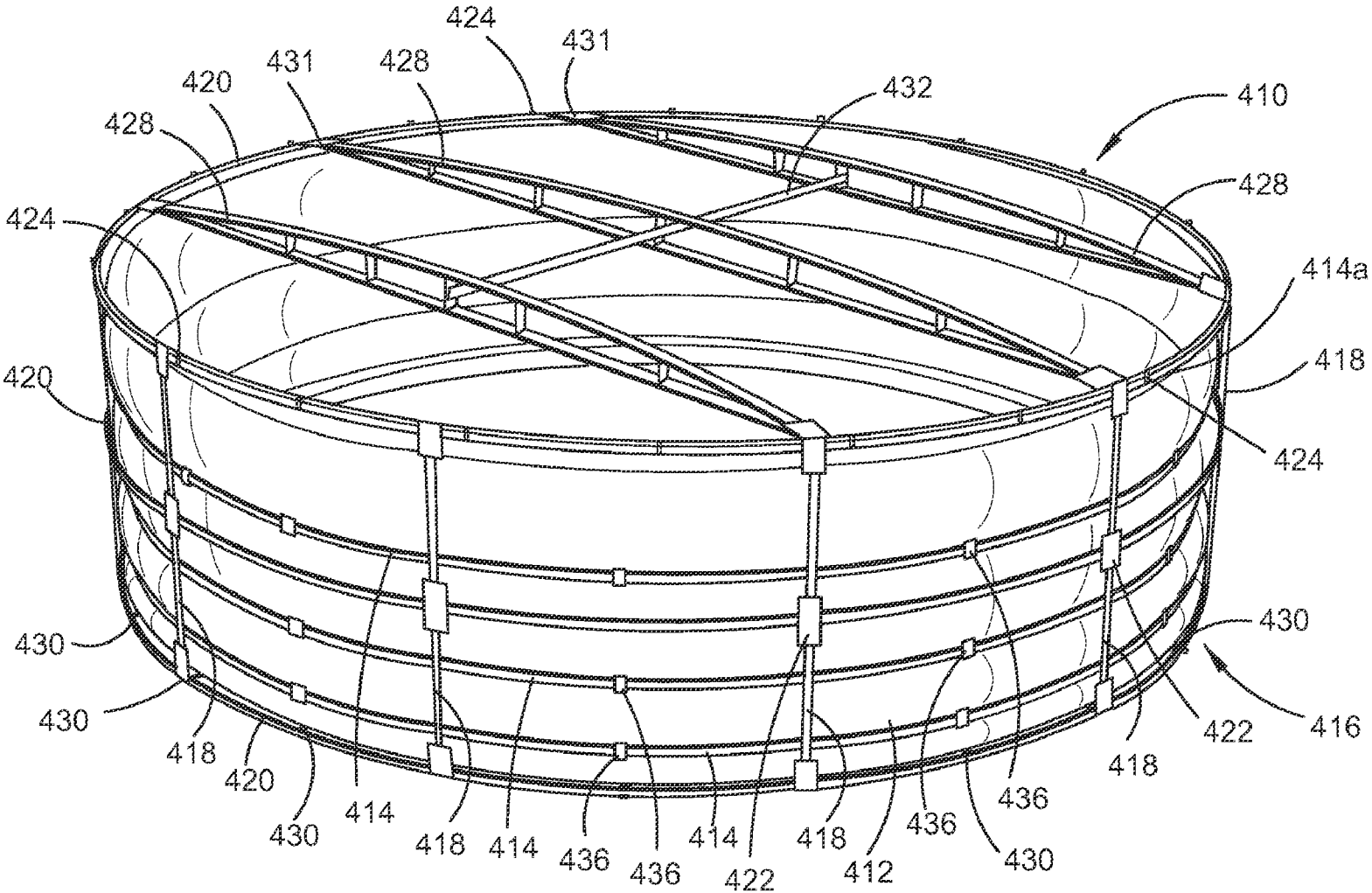
FIG. 9: is a schematic perspective view of an apparatus according to a fifth embodiment of the present invention.

FIG. 9 shows an apparatus for storing a flowable product 410 according to a fifth embodiment of the present invention. The apparatus 410 has many features similar to that of the apparatus 10 of the first embodiment. Accordingly, features of the apparatus 410 that generally correspond with features of the apparatus 10 shown in FIG. 1 have been assigned corresponding reference numerals incremented by 400.

The apparatus 410 is similar to the apparatus 310 shown in FIGS. 5 to 8, but further includes keepers 436 on the side wall of the receptacle 412 to form sleeves. The hoops 414 pass through the sleeves to locate the hoops 414 relative to the side wall, and thus maintain the vertical position of the respective hoop 414.

The apparatus 410 also has restraints 431 for locating the lower portion of the receptacle 412 relative to the frame 416. In particular, the restraints 431 locate and restrain the base 413 of the receptacle 412 to the bottom ring 420.

The hoops 414 can be made of a flexible material, such as an elongate member formed by twisted and/or woven strands, such rope, cable or webbing material. In embodiments in which the hoops 414 are made of flexible material, a length of the flexible material can be threaded through the keepers 436 and the ends releasably or permanently joined to form the hoops 414. In some embodiments, a tensioner may be provided to each hoop 414 to allow the length and/or tension of the respective hoop 414 to be adjusted.

In some non-illustrated embodiments, the receptacle has three or more side walls. Thus, the receptacle can have the shape of a prism of three or more sides. The side walls can be substantially planar in the absence of liquid in the receptacle or they may be curved.

The hoops can be any form of substantially inelastic material. For example, the hoops can be in the form of strips, wound cables or wires. The hoops can be formed of plastics materials, fiber-reinforced plastics or metals.

In some embodiments in which the hoops are made of, or include, a plastics material, the hoops can be plastic welded to the side wall of the receptacle. In certain embodiments in which the hoops are made of woven strands of material and the receptacle is made from polyvinyl chloride (PVC), the hoops may be coated with PVC and subsequently welded to the receptacle.

The hoops may be segmented such that each hoop is formed of two or more hoop segments that are joined at their ends to form the hoop.

In some embodiments, the rings can be connected to the columns such that the outer surfaces of the columns and rings are flush at their intersections.

It will be appreciated that the rings of the frame do not have to be circular. The rings may comprise a number of distinct sections to form an overall polygon shape when viewed in plan.

As will be appreciated, apparatus of the present invention can include plumbing fittings to provide any of: a liquid inlet, a liquid outlet and/or a liquid overflow.

Apparatus of the present invention can be used to store flowable products other than liquid, such as grains and powders.

The apparatus of the present invention can be provided as a set of components that are assembled at the desired location.

It will be understood to persons skilled in the art of the invention that many modifications may be made without departing from the spirit and scope of the invention.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. An apparatus for storing flowable product comprising:

a receptacle formed of a fabric that is impermeable to the flowable product, the receptacle defining an open cylinder having a base, an upstanding side wall and a brim, a plurality of lateral inelastic bracing hoops disposed spaced between the base and the brim of the receptacle to peripherally abut the side wall of the receptacle and absorb hoop stresses within the receptacle, and a frame positioned externally of the receptacle comprising a plurality of spaced upright columns joined by a plurality of spaced circumferential rings, the frame being secured to the receptacle adjacent the brim of the receptacle to support the receptacle with the upright columns clear of the hoops and the receptacle inside the columns.

2. An apparatus according to claim 1, wherein the apparatus has three or more lateral bracing hoops, the vertical separation of adjacent lateral bracing hoops increases with vertical height from the base of the receptacle.

3. An apparatus according to claim 1, further comprising a top supporting member that supports the brim of the receptacle.

4. An apparatus according to claim 1, wherein the receptacle has keeper sleeves within which the lateral bracing hoops are contained.

5. An apparatus according to claim 1, wherein the lateral bracing hoops are in the form of strips of inelastic material.

6. An apparatus according to claim 5, wherein the strips are formed of metal or an inelastic plastics material.

7. An apparatus according to claim 1, wherein the lateral bracing hoops are formed of a plurality of interconnected segments.

8. An apparatus according to claim 1, wherein the rings are external to the columns.

9. An apparatus according to claim 8, wherein the outer diameter of the rings is larger than the diameter of the receptacle when filled with product.

10. An apparatus according to claim 1, further comprising an external cladding that is attached to the rings.

11. An apparatus according to claim 1, wherein the plurality of rings include a top ring that supports the brim of the receptacle.

12. An apparatus according to claim 11, wherein the plurality of rings include a bottom ring that is located toward the base of the apparatus.

13. An apparatus according to claim 12, wherein the plurality of rings includes one or more intermediate rings located between the top and bottom rings.

14. An apparatus according to claim 1, further comprising connectors that connect the brim of the receptacle to one of the rings at the top of the frame.

15. An apparatus according to claim 1, wherein the frame includes gussets that each extend between one of the columns and one of the rings to provide increased rigidity to the frame.

* * * * *